US009016486B2

(12) United States Patent
Noll

(10) Patent No.: US 9,016,486 B2
(45) Date of Patent: Apr. 28, 2015

(54) TRAVELING CRANE HAVING TRAVELER AND HOISTING WINCH

(75) Inventor: Stefan Noll, Burscheid (DE)

(73) Assignee: Terex MHPS GmbH, Duesseldorf (DE)

( * ) Notice: Subject to any disclaimer, the term of this patent is extended or adjusted under 35 U.S.C. 154(b) by 426 days.

(21) Appl. No.: 13/388,209

(22) PCT Filed: Jul. 27, 2010

(86) PCT No.: PCT/EP2010/060923

§ 371 (c)(1),
(2), (4) Date: Feb. 28, 2012

(87) PCT Pub. No.: WO2011/015496

PCT Pub. Date: Feb. 10, 2011

(65) Prior Publication Data

US 2012/0193315 A1 Aug. 2, 2012

(30) Foreign Application Priority Data

Aug. 6, 2009 (DE) ..... 10 2009 036 356

(51) Int. Cl.
*B66C 17/00* (2006.01)
*B66C 19/00* (2006.01)
*B66D 1/39* (2006.01)
(Continued)

(52) U.S. Cl.
CPC . *B66D 1/39* (2013.01); *B66C 19/00* (2013.01); *B66C 2700/012* (2013.01); *B66D 1/12* (2013.01); *B66D 1/26* (2013.01); *B66D 2700/0166* (2013.01)

(58) Field of Classification Search
USPC ..... 254/278; 212/312, 315, 324, 325
See application file for complete search history.

(56) References Cited

U.S. PATENT DOCUMENTS 3,043,444 A * 7/1962 Melton ..... 212/274
5,423,438 A 6/1995 Swanson

FOREIGN PATENT DOCUMENTS

DE 1192381 B 5/1965
DE 29816005 U1 12/1998

(Continued)

OTHER PUBLICATIONS

English translation of International Preliminary Report on Patentability from corresponding PCT Application No. PCT/EP2010/060923, dated Feb. 6, 2012.
English translation of the International Search Report of the International Searching Authority from corresponding Patent Cooperation Treaty (PCT) Application No. PCT/EP2010/060923, mailed Nov. 29, 2010.

(Continued)

*Primary Examiner* — Sang Kim
*Assistant Examiner* — Juan Campos, Jr.
(74) *Attorney, Agent, or Firm* — Gardner, Linn, Burkhart & Flory, LLP

(57) ABSTRACT

A traveling crane includes a longitudinal beam displaceable on rails. A traveler having a hoisting winch with a cable drum is displaceable in a transverse direction, and is operable to wind a cable reeved through at least one lower block. The hoisting winch is displaceable relative to the traveler in a hoisting winch travel direction such that a cable run out point remains in one location relative to the longitudinal extent of the cable drum. Two winching hoists are provided which are displaceable transversely to the longitudinal beam with respective cable drums thereof being disposed parallel to and spaced from each other. A common cable can be wound up and down by the two cable drums, and the two cable drums include cable grooves running in opposite directions. The two cable drums are operable in the opposite direction of rotation for lifting and lowering a load.

1 Claim, 4 Drawing Sheets

(51) Int. Cl.
*B66D 1/12* (2006.01)
*B66D 1/26* (2006.01)

(56) References Cited

FOREIGN PATENT DOCUMENTS

| | | | |
|---|---|---|---|
| DE | 10117466 | A1 | 10/2002 |
| EP | 0571207 | A1 | 11/1993 |
| GB | 714071 | A | 8/1954 |
| JP | 2001002379 | A | 1/2001 |

OTHER PUBLICATIONS

International Search Report and Written Opinion of the International Searching Authority from corresponding PCT Application No. PCT/EP2010/060923, mailed Nov. 29, 2010.
International Preliminary Examination Report (IPER) of the International Searching Authority from corresponding PCT Application No. PCT/EP2010/060923, mailed Aug. 29, 2011.
German Examination Report dated Nov. 16, 2009 in connection with German parent (priority) application DE10 2009 036 356.4-22.

* cited by examiner

TRAVELING CRANE HAVING TRAVELER AND HOISTING WINCH

FIELD OF THE INVENTION

The invention relates to a travelling crane having a longitudinal beam which is displaceable on rails and along which a travelling trolley is displaceable in a transverse direction.

BACKGROUND OF THE INVENTION

Travelling cranes for lifting and lowering loads are generally known. Such travelling cranes are characterised by one or two beams which at their ends are displaceable on rails via travelling mechanisms. These rails are disposed in warehouses on their longitudinal sides in the region of the roofs, for example. A crane trolley, on which a hoisting winch is mounted, is displaceable on or at the longitudinal beam in a transverse manner with respect to the travel direction of the longitudinal beam. Such hoisting winches consist substantially of a cable drum which is driven in a lifting and lowering direction by means of a gearbox and an electric motor. In order to be able to lift large bearing loads of e.g. 80 t or 150 t by means of a hoisting winch such as this, the cable is typically reeved. The reasons for this are predominantly financial, since reeving is more cost-effective than corresponding dimensioning of the gearbox which is a function of cable strength and drum diameter. Typically, an 8/2 reeving is used, such as for an 80 t hoisting winch, or a 12/2 reeving is used for a 150 t hoisting winch. Such reevings ensure that the load hook is formed as a lower block and in the region of the hoisting winch upper blocks are provided in the form of pivotably suspended pulleys. An 8/2 reeving requires the use of a double-grooved cable drum having cable grooves running in opposite directions, from which the two ends of a cable run out and are guided by a total of three upper blocks and four pulleys in the region of the lower block. Since in the region of the lower block a total of 8 cable strands are fed in and out and two cable strands are wound or unwound by the cable drum, this is referred to as an 8/2 reeving. Use of two driven cable strands of a cable drum, which run out from cable grooves running in opposite directions, has the advantage that during the lifting and lowering procedure the lower block moves only in the lifting and lowering direction and does not travel along the axis of rotation of the cable drum. However, the above-described large reevings of 8/2 or 12/2 also require correspondingly longer cable lengths. As a consequence, a correspondingly long cable drum must be provided or the diameter thereof must be selected to be larger. However, the length of the cable drum is limited by the maximum permissible deflection angle transverse to the longitudinal direction of the cable drum. In general, the cable drum diameter is thus increased. A larger cable drum diameter requires a larger gearbox output torque. A maximum gearbox output torque of a gearbox can thus limit the maximum possible bearing load of the hoisting winch. In the case of large cable deflection angles the cable is also subjected to a substantial stress loading. This leads to a reduction in the serviceable life of the cable and also in the serviceable life of the cable drum and all deflection rollers. This also makes it more difficult to theoretically calculate the serviceable life of the cable using the existing cable deflection angle which changes in the longitudinal direction of the cable drum.

Furthermore, German patent DE 101 17 466 B4 discloses an electrical hoisting winch for use as a stage winch. Such stage winches are used for lifting and lowering curtains and scenery items. Typically, the curtains or scenery items are suspended via several cables at several points along the width of a stage. In order to ensure that the curtains and scenery items are lifted and lowered in a uniform manner, the cables must be wound or unwound synchronously by the hoisting winch. Such hoisting winches thus comprise hoisting winches which are disposed next to each other and are mounted on a common drum shaft. In this case, the drum shaft is driven by one or several electrical drive motors via a gearbox. Since in the case of a stage several curtains and pieces of scenery are disposed at a small spaced interval one behind the other as seen in relation to the depth of the stage, it is not possible for several hoisting winches to be disposed one behind the other, as their installation width is too large. Rather, the hoisting winches for this purpose have at least one deflection roller for each cable, in order to deflect the cable, which in each case runs out horizontally from the cable drum, to a vertical direction in the direction of the stage. These deflection rollers are disposed in a positionally fixed manner on a crossbar which is supported on the hoisting winch. In the case of this hoisting winch, in order to ensure that the curtains and scenery items are lifted and lowered in an absolutely uniform manner, provision is additionally made to avoid any lengthening and shortening of the cable length between the cable run-out points of the cables from the respective cable drum and the deflection roller, which would occur on account of the cable run-out point travelling along the cable drum. For this purpose, the entire hoisting winch is disposed on a drum slide which is displaceable in the longitudinal direction of the drum axis in relation to a stationary support frame of the hoisting winch. The drum slide is displaced relative to the support frame and the deflection rollers by means of a spindle drive such that the drum slide is displaced synchronously with the rotation of the drum by a displacement distance of about one cable diameter per drum rotation. This ensures that the respective cable running out from the cable drum runs into the deflection roller approximately at a right angle to the axis of rotation of the deflection roller. The cable length between the cable run-out point of the cable drum and the deflection roller is therefore not lengthened or shortened, as a result of which there is also no fluctuation in the lifting and lowering speed which this otherwise causes.

Moreover, Japanese laid-open document JP 2001-2379 A discloses a travelling crane having a travelling trolley which is displaceable on a longitudinal beam of the travelling crane via rollers. The travelling trolley typically has a hoisting winch having a cable drum. The hoisting winch and therefore its cable drum are displaceable relative to the travelling trolley via further rollers. In this case, the travel direction of the travelling trolley and the longitudinal direction of the cable drum correspond. The cable drum is displaced relative to the travelling trolley by means of a hydraulic cylinder. This additional displaceability of the cable drum relative to the travelling trolley is intended to ensure that the cable run-out point of the cable remains in one location in relation to the longitudinal extension of the cable drum during winding and unwinding of the cable.

U.S. Pat. No. 5,423,438 discloses a travelling crane having a travelling trolley which comprises two hoisting winches each with a cable drum. The cable drums are disposed in parallel and spaced apart from each other and can be rotated in opposite directions. A first and second common cable can be wound and unwound from the cable drums. The two cables are reeved via a first or second cable pulley of a lower block and run out with a total of four cable strands from the cable drums. The cable pulleys are rotatably mounted in the lower block via spindles extending in parallel with the axes of rotation of the cable drums and are freely moveable and displaceable along same. The cable run-out points which travel away from each other or towards each other along the cable drums during winding and unwinding of the cables produce variable cable run-out angles between the individual cable strands and the cable drums or cable pulleys. By virtue of the cables which run out, axially effective forces are introduced into the cable pulleys which consequently are tracked automatically to the travelling cable run-out points. As a consequence, the cable run-out angles are reduced.

German laid-open document DE 1 192 381 B describes a travelling crane having a travelling trolley which comprises four hoisting winches each comprising a cable drum. Each of the cable drums serves to wind and unwind a cable which at its free end is attached to a load receiving means via a hook. The cables running out from the cable drums are each guided via a deflection roller. In order to ensure that the cables encounter the deflection roller at a constant cable run-out angle, the travel of the cable run-out points of the cables along the cable drums is equalised by displacing the cable drums along the rotational spindles, which support them, by means of the cable forces which act accordingly upon the cable drums.

European patent application EP 0 571 207 A1 relates to a cable guiding device for winding and unwinding a cable in multiple layers onto a cable drum of a hoisting winch. The cable drum is attached to a slide. In order to ensure that the cable run-out point remains constant in the region of the guide rollers for the purpose of winding the cable in an orderly fashion, the slide is displaceable along two rails via rollers relative to a positionally fixed arrangement of guide rollers. The displacement of the slide is likewise effected by the occurring cable forces.

British patent application GB 714 071 A discloses a dockside crane having a telescopic jib and a telescopic mast suspended thereon. In the interior of the jib, a hoisting winch is horizontally displaceable via a travelling trolley, whose cable is guided through the interior of the jib or the mast. In order to ensure that the cable, which runs out vertically downwards from the cable drum of the hoisting winch, maintains the central position in relation to the mast during winding and unwinding in spite of the cable run-out point which travels in relation to the cable drum, the travel of the cable run-out point or of the cable is counteracted by corresponding displacement of the travelling trolley along the jib.

SUMMARY OF THE INVENTION

The present invention provides a travelling crane having a longitudinal beam which is displaceable on rails and which has an improved construction.

According to one aspect of the invention, a travelling crane is provided which has a longitudinal beam that is displaceable on rails and along which a travelling trolley is displaceable in a transverse direction. The travelling trolley includes exactly two hoisting winches, each including a cable drum, wherein the cable drums each have an axis of rotation extending transversely with respect to the transverse direction. The cable drums are disposed next to each other in parallel with and at a spaced interval from each other, and can be operated in an opposite direction of rotation for lifting and lowering a load. An improved construction may be achieved by providing the two cable drums each with exactly one cable groove, the cable grooves being formed so as to rotate in opposite directions to each other. Exactly one common cable is reeved via at least one lower block can be wound and unwound by the two cable drums. A hoisting winch trolley is disposed on the travelling trolley, the two hoisting winches are disposed on the hoisting winch trolley, and the hoisting winch trolley is displaceable via travelling mechanisms on a transverse beam of the travelling trolley in a hoisting winch travel direction, which extends transversely with respect to the transverse direction. The hoisting winches are displaceable relative to the travelling trolley by means of the hoisting winch trolley such that in each case a cable run-out point of the cable, which travels along the corresponding cable drum, remains in one location in relation to the longitudinal extension of the cable drum. A drive for the travelling mechanisms of the hoisting winch trolley is coupled to an electric drive of the hoisting winch via a controller, such that the cable run-out point of the cable remains in one location in relation to the longitudinal extension of the cable drum.

Accordingly, the serviceable life of the cable and the cable drum or of the cable grooves present on the cable drum may be increased. Since a maximum permitted cable deflection angle is a factor that limits the length of the cable drum, it is possible for the length of the cable drum to be increased and therefore for the diameter of the cable drum to be reduced, while substantially limiting or preventing any travel of the cable run-out point. The reduction in diameter of the cable drum is associated with a decrease in the maximum gearbox output torque, so that the gearbox can be made smaller in dimension or a standard gearbox can be used for a greater range of bearing loads within a cable winch type series.

Optionally, the cable run-out point may be automatically fixed by the actuation of the travelling mechanism drives.

These and other objects, advantages and features of this invention will become apparent upon review of the following specification in conjunction with the drawings.

DESCRIPTION OF THE PREFERRED EMBODIMENTS

Figure 1:
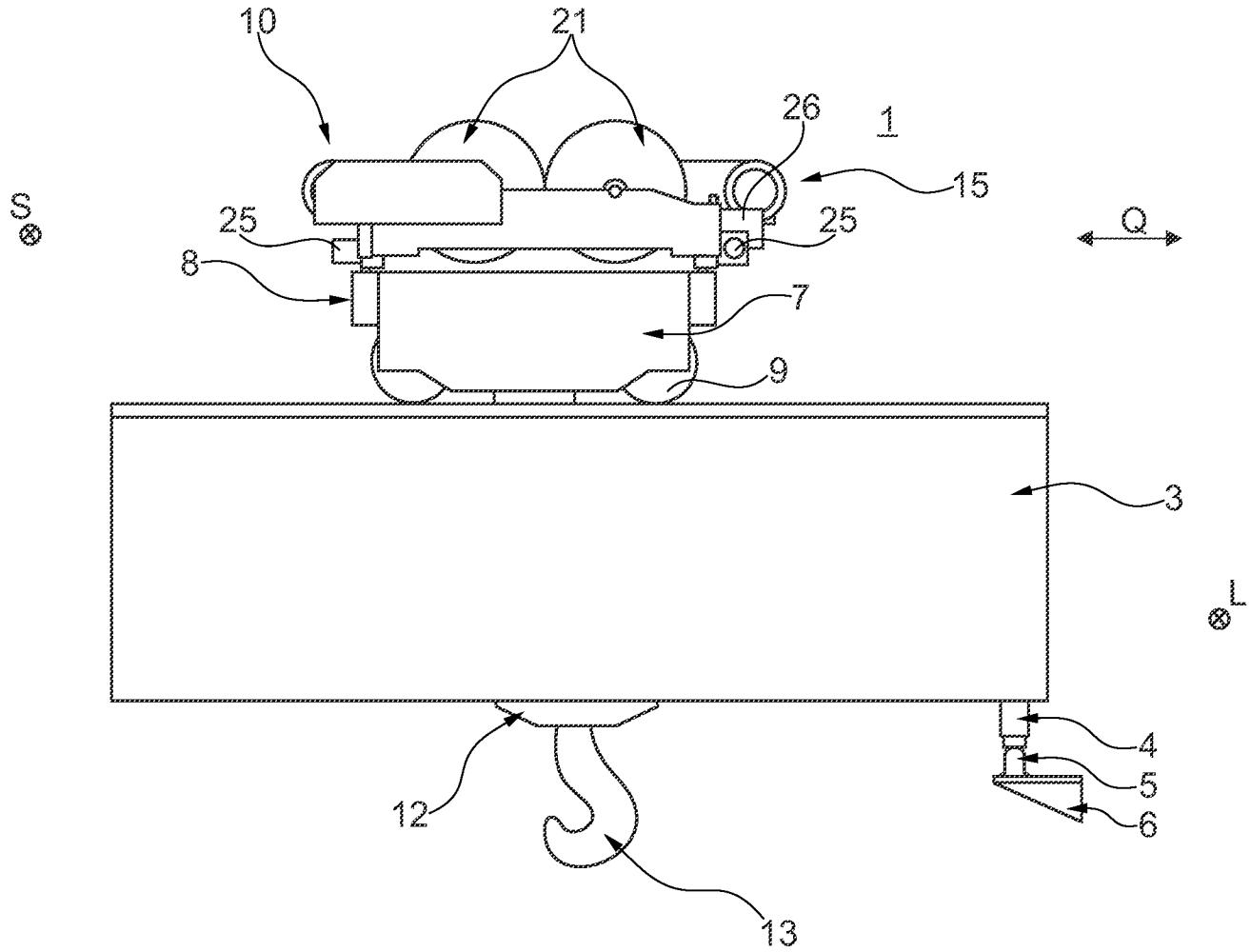
FIG. 1 is an end elevation of a portion of a travelling crane in accordance with the present invention.

Referring now to the drawings and the illustrative embodiments depicted therein, a travelling crane 1 is provided which can be operated in a warehouse or outdoors, for example (FIG. 1). The travelling crane 1 typically includes a longitudinal beam 3, of which only sections with its right-hand end portion are illustrated in FIG. 1. The longitudinal beam 3 is supported at its two opposite ends by rails 5, and is displaceable on rails 5 in the longitudinal direction L thereof via travelling mechanisms 4 (only one of rails 5 is shown in FIG. 1). The rails 5 are attached via brackets 6 to a wall of a warehouse, for example, such as in the region of the roof of this warehouse, or are elevated via supports.

On or at the longitudinal beam 3, a travelling trolley 7 is displaceable along the longitudinal beam 3 in a transverse direction Q. The transverse direction Q extends at a right angle with respect to the longitudinal direction L. The travelling trolley 7 includes a frame 8, which is displaceable on the longitudinal beam 3 via travelling mechanisms 9, and the travelling trolley 7 further includes two hoisting winches 10. A lower block 12 having a load hook 13 is suspended on a cable 11, which rims out from the two hoisting winches 10.

The cable 11 is reeved so that upper blocks are disposed in the region of the travelling trolley 7. In the illustrated embodiment, three upper blocks are present, since an 8/1 reeving is provided for two hoisting winches 10, (i.e., a 2×8/1 reeving is provided).

Figure 2:
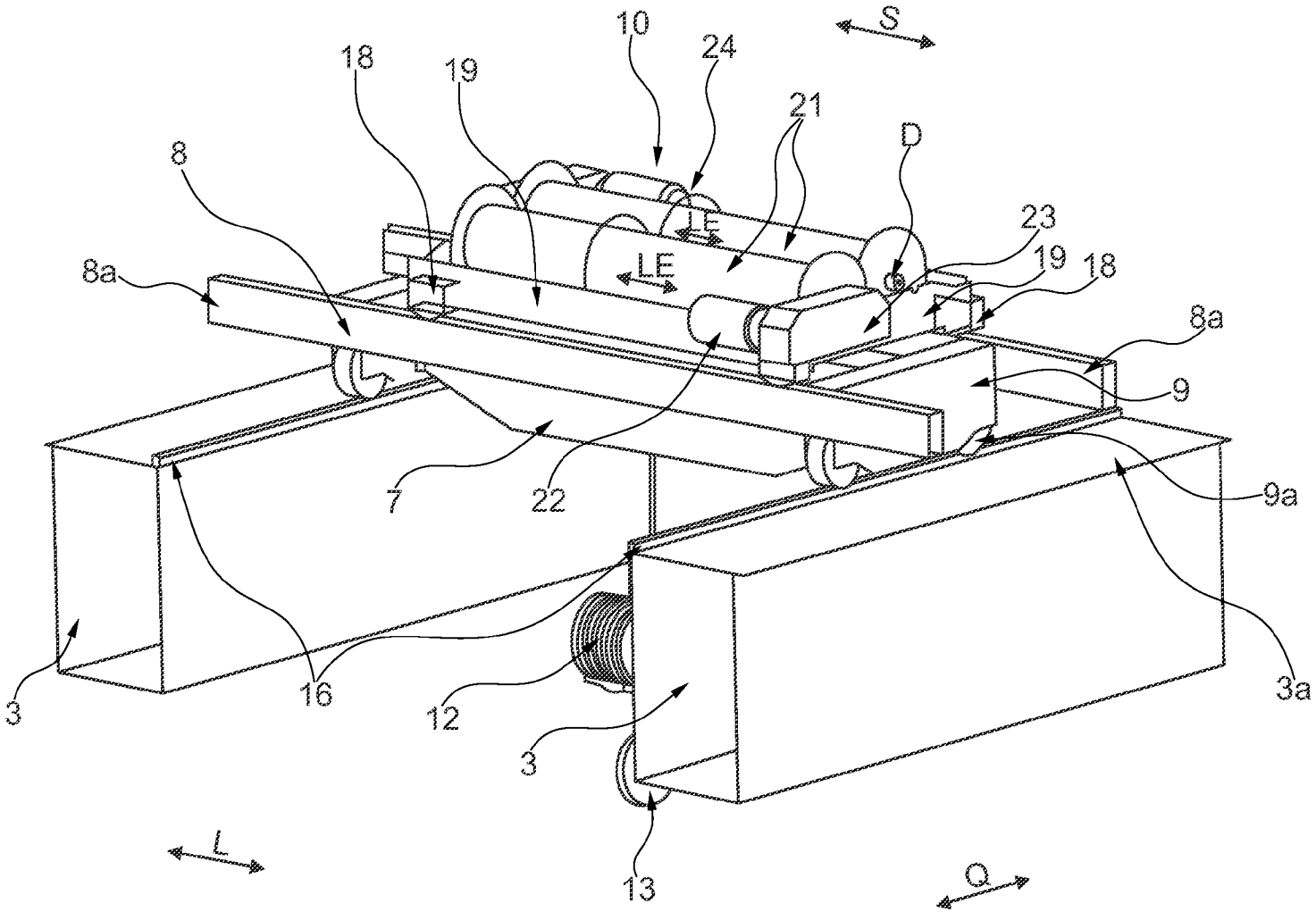
FIG. 2 is a perspective view of the travelling crane of FIG. 1, taken from the region of a travelling trolley of the travelling crane.

The travelling trolley 7 is distinguished from known travelling trolleys by, for example, a further hoisting winch trolley 15 that is provided for displacing the hoisting winches 10 not only in the transverse direction Q along the longitudinal beam 3 of the travelling crane 1, but also independently of the longitudinal beams 3 in a hoisting winch travel direction S, which extends at a right angle with respect to the transverse direction Q and substantially in parallel with the longitudinal direction L, such as shown in FIG. 2.

As best shown in FIG. 2, the travelling crane 1 is configured as a dual-beam travelling crane having two longitudinal beams 3 which extend in parallel with and at a spaced interval from each other. This construction takes place primarily in travelling cranes 1 for bearing heavy loads. The travelling crane 1 shown in the illustrated embodiment is provided for bearing loads in the range of 50 to 200 t, for example. Rails 16, on which the travelling trolley 7 rolls with its travelling mechanisms 9, are attached to an upper side 3*a* of the longitudinal beams 3. For reasons of clarity, only one travelling mechanism 9 is illustrated with two wheels 9*a* in each case. The travelling mechanisms 9 are attached to a rectangular frame 8 of the travelling trolley 7. The frame 8 includes two transverse beams 8*a* that extend in parallel with and at a spaced interval from each other and on which, in turn, rails 17 are attached. These rails 17 extend in the hoisting winch travel direction S and thus are aligned transversely with respect to the transverse direction Q of the longitudinal beams 3.

The hoisting winch trolley 15 is displaceable on the rails 17 in the hoisting winch travel direction S via further travelling mechanisms 18. The construction of the hoisting winch trolley 15 is comparable to that of conventional crane travelling trolleys. The two hoisting winches 10 are mounted on a trolley frame 19 of the hoisting winch trolley 15. In a conventional construction, the hoisting winches 10 include a cable drum 21 which is mounted on the trolley frame 19 in such a manner as to be able to rotate about an axis of rotation D. In this case, the axis of rotation D extends in parallel with the hoisting winch travel direction S and substantially horizontally. The axes of rotation D of the two cable drums 21 are also disposed in a common horizontal plane. The cable drums 21 are driven via an electric motor 22, which is connected to the cable drum 21 via a gearbox 23 that is supported on the trolley frame 19. The cable drums 21 are provided with cable grooves 24, of which only a section is schematically illustrated with the length of the circumference of the cable drum 21. The cable drums 21 are designed as single-groove cable drums 21.

Corresponding to the 2×8/1 reeving which is used, only one common cable 11 is wound or unwound by the two cable drums 21. In this case, the cable grooves 24 run in opposite directions. Since the two cable drums 21 are operated with an opposite direction of rotation in each case for lifting a load or lowering a load, the cable 11 which runs out between the two cable drums 21 is wound or unwound in the desired manner.

Figure 3:
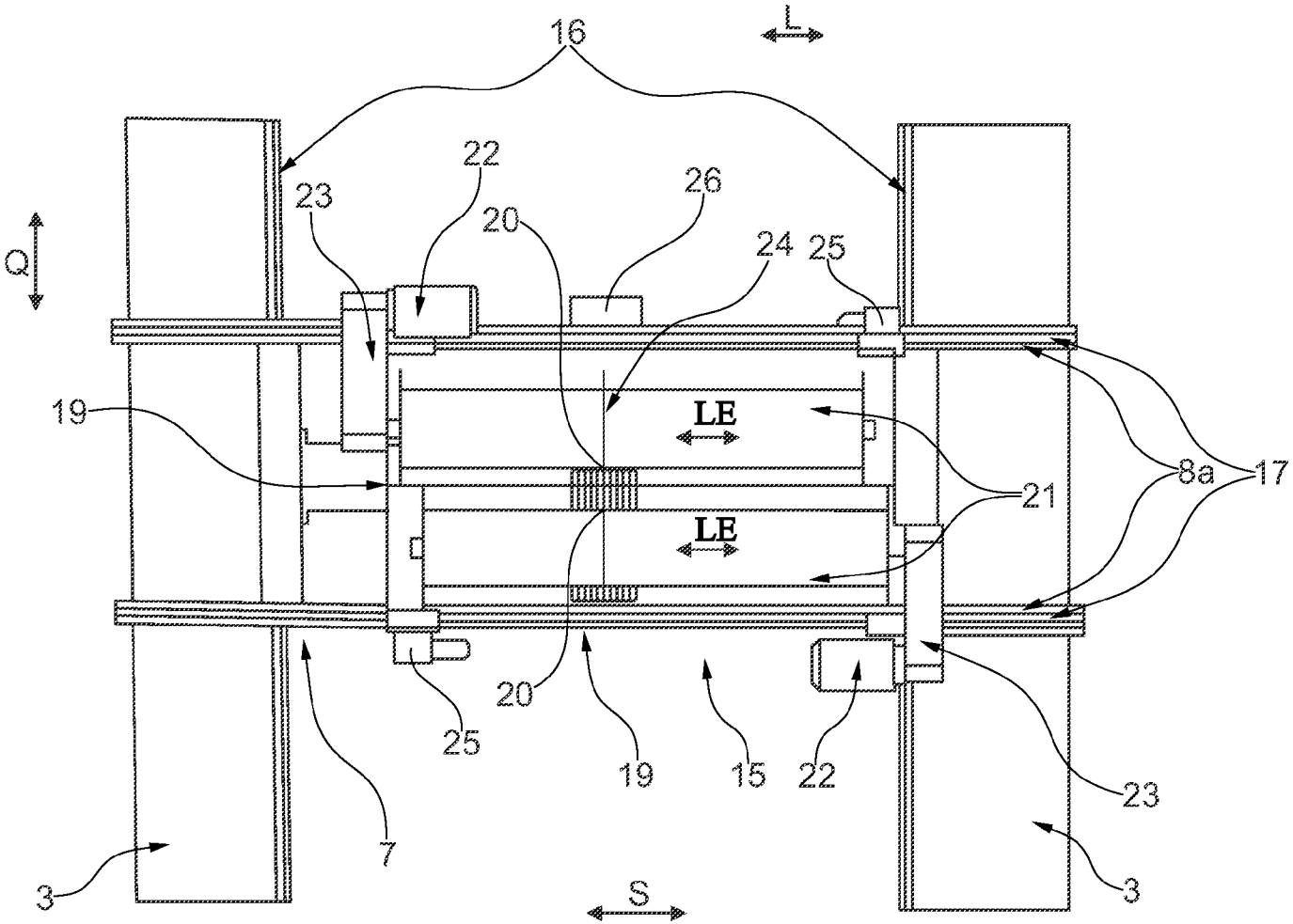
FIG. 3 is a top plan view of the travelling crane of FIG. 1.

The longitudinal beams 3 of the dual-beam travelling crane extend at a spaced interval from and in parallel with each other, such as best shown in FIG. 3. The lower travelling trolley 7 and the upper trolley 15 form a type of cross trolley, since the hoisting winches 10 are displaceable by means of the travelling trolley 7 not only in the transverse direction Q along the longitudinal beams 3, but also by means of the hoisting winch trolley 15 in the hoisting winch travel direction S transversely with respect thereto. In this case, the hoisting winch travel direction S and the transverse direction Q extend substantially horizontally in the planes that are spaced apart from each other in the vertical direction.

The cable grooves 24, in which the cable 11 can be wound and unwound in one layer, extend along the cable drums 21, such as shown schematically in FIG. 3.

As best shown in FIG. 3, the cable 11 is virtually half-unwound from the cable drums 21 and the lower block 12 with the load hook 13 is located in a central position. Accordingly, the cable run-out points 20 of the cables are located in the region of the centre of the cable drums 21. Accordingly, the hoisting winch trolley 15 is located on the travelling trolley 7 in a central position as seen in the hoisting winch travel direction S. Should the lower block 12 then be lowered, the cable run-out points 20 travel in the direction of the hoisting winch travel direction S, i.e. to the right as shown in FIG. 3. Since corresponding travel of the lower block 12 and thus a lateral deflection of the cables 11—as seen in the direction of the axes of rotation D of the cable drums 21—is not desired when the cables depart from the cable grooves 24, the entire hoisting winch trolley 15 is displaced with the hoisting winches 10 along the rails 17 (to the left as shown in FIG. 3). In this case, the electric motors 22 for the cable drums 21 are connected via a controller 26 to a travelling drive 25 for the travelling mechanisms 18, such that the cable run-out point 20 remains in one location in relation to the longitudinal direction of the cable drums 21 in spite of the cable grooves 24 travelling along the cable drums 21.

Figure 4:
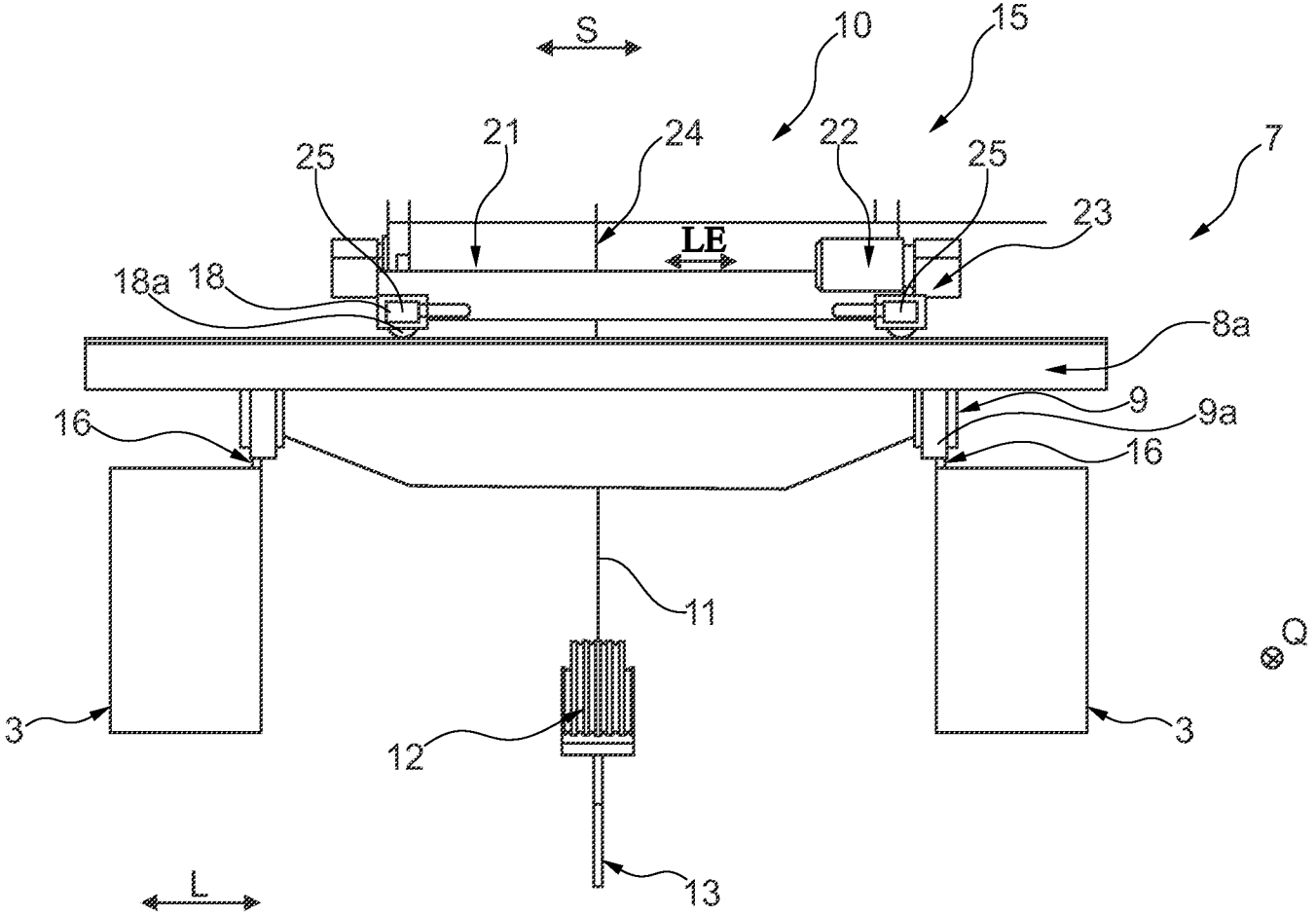
FIG. 4 is a side elevation of the travelling crane of FIG. 1.

As shown in FIG. 4, it is clearly apparent that the hoisting winch trolley 15 is supported on the longitudinal beams 3 via the travelling trolley 7. Moreover, only one cable strand 11 is schematically illustrated, although a total of 8 cable strands 11 run out in accordance with the selected 2×8/1 reeving. Therefore, there are also a total of eight on the two cable drums 21. In order to simplify the description of the invention, the four cable run-out points 20 at one cable drum 21, in relation to a longitudinal extension LE of the cable drum 21, are combined to form one cable run-out point 20 in the centre of the four cable run-out points.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A travelling crane comprising:

a longitudinal beam that is displaceable on rails in a longitudinal direction;

a travelling trolley that is displaceable in a transverse direction along the longitudinal beam, the travelling trolley comprising a plurality of winches, said plurality of winches consisting of exactly two and not more than two hoisting winches, each of the hoisting winches comprising a cable drum and an electric drive for rotatably driving the respective cable drum, each cable drum having an axis of rotation extending transversely with respect to the transverse direction, the travelling trolley further comprising a travelling mechanism supported on a transverse beam;

wherein the cable drums are disposed next to each other in parallel with and at a spaced interval from each other and are operable in opposite directions of rotation for lifting and lowering a load, each of the two cable drums having a groove consisting of exactly one and not more than one cable groove, wherein the respective cable grooves are formed so as to rotate in opposite directions to each other;

a cable consisting of exactly one and not more than one common cable reeved via at least one lower block, wherein the two cable drums are operable to wind and unwind the common cable, and wherein the common cable defines a cable run-out point;

a hoisting winch trolley disposed on the travelling trolley and displaceable along the travelling trolley in the longitudinal direction, wherein the two hoisting winches are disposed on the hoisting winch trolley and the hoisting winch trolley is displaceable via the travelling mechanism on the transverse beam of the travelling trolley in a hoisting winch travel direction that extends in the longitudinal direction;

a controller connected to the electric drives of the hoisting winches; and a travelling drive for the travelling mechanisms of the hoisting winch trolley, the travelling drive being coupled to the electric drive of the hoisting winch via the controller;

wherein the hoisting winch trolley is operable to move along the travelling trolley to thereby move the hoisting winches relative to the travelling trolley so that the cable run-out point of the common cable, which travels along the corresponding cable drums, remains in one location in relation to longitudinal extensions of the cable drums during operation of the hoisting winches.

* * * * *

UNITED STATES PATENT AND TRADEMARK OFFICE

CERTIFICATE OF CORRECTION

PATENT NO. : 9,016,486 B2
APPLICATION NO. : 13/388209
DATED : April 28, 2015
INVENTOR(S) : Stefan Noll It is certified that error appears in the above-identified patent and that said Letters Patent is hereby corrected as shown below:

Specification

Column 4
Line 67, “rims” should be --runs--

Signed and Sealed this
Eighth Day of December, 2015

Michelle K. Lee

Michelle K. Lee
*Director of the United States Patent and Trademark Office*